United States Patent [19]

Hässler et al.

[11] 3,985,512

[45] Oct. 12, 1976

[54] TELLURIDE CONTAINING IMPREGNATED ELECTRIC CONTACT MATERIAL

[75] Inventors: Heinrich Hässler, Wendelstein; Horst Schreiner, Nurnberg, both of Germany

[73] Assignee: Siemens Aktiengesellschaft, Munich, Germany

[22] Filed: Oct. 18, 1973

[21] Appl. No.: 407,618

[30] Foreign Application Priority Data

Nov. 8, 1972 Germany ..... 2254623

[52] U.S. Cl. ..... 29/182.1; 29/182; 252/512; 252/514; 252/515; 252/518; 200/264

[51] Int. Cl.[2] ..... C22C 28/00; H01H 1/02

[58] Field of Search ..... 29/182, 182.1; 252/514, 252/515, 512, 518; 200/264

[56] References Cited

UNITED STATES PATENTS

| | | | |
|---|---|---|---|
| 3,366,463 | 1/1968 | Schreiner | 29/182.1 |
| 3,438,753 | 4/1969 | Kenney et al. | 29/182.1 |
| 3,505,065 | 4/1970 | Gwyn | 29/182.1 X |
| 3,721,550 | 3/1973 | Schreiner et al. | 29/182.1 X |

FOREIGN PATENTS OR APPLICATIONS

| | | |
|---|---|---|
| 2,014,639 | 10/1971 | Germany |

*Primary Examiner*—Richard E. Schafer
*Attorney, Agent, or Firm*—Kenyon & Kenyon Reilly Carr & Chapin

[57] ABSTRACT

Electric contact material having good solderability, consists of a porous matrix of sintered powder particles of a refractory metal, such as tungsten or molybdenum, with its pores impregnated with a metal alloy consisting of a telluride-forming metal, such as copper, silver or lead, and a sufficient amount of a telluride of such metal to form a brittle deposit of tellurium and the telluride-forming metal, both in elemental form, on the material's surface, apparently produced by decomposition and vaporization of the telluride due to electrical arcing, and which vapor after the arcing and rapid cooling of the material, condenses on the material's surface to form the deposit. This brittle deposit provides an effective reduction in the contact welding force of the material as compared to prior art electric contact materials of good solderability.

2 Claims, No Drawings

TELLURIDE CONTAINING IMPREGNATED ELECTRIC CONTACT MATERIAL

BACKGROUND OF THE INVENTION

The invention relates to electric contact material of the type consisting essentially of a porous matrix of a refractory metal, particularly tungsten or molybdenum, and having its pores impregnated with a metal alloy.

Material of this type is used for making the contacts of heavy-duty vacuum switches relied on to make a high number of switching cycles. Such contacts must meet stringent requirements with respect to burn-off resistance, for example, resistance to burn-off may be required for more than $10^6$ switching cycles at the rated current capacity of the switch. Such contacts should have the ability to control interrupt currents of from 2 to 3 kA. A low welding or sticking force between the opening switch contacts is also required, a typical requirement being that the force required for contact separation should be less than 300 newtons for pulse currents of 300 kA, and the interrupt current must be small, for example, less than 5 A.

In addition to the above requirements, for reasons of mechanized production of such vacuum switches, it should be possible to easily solder the contacts to the contact carrying studs or current conducting elements of the switches.

To cope with the foregoing requirements, electric contact material has been made by powder metal techniques in combination of WCu, MoCu or WCuBi; or by metallurgical melting processes, from NiCTe. WCu and MoCu contacts meet the requirements as to burn-off resistance, low interrupt current and solderability, but not the requirement as to low welding force. Contacts of WCuBi provide a low welding force, but according to the present state of the art, are not solderable. NiCTe, on the other hand, has insufficient service life because of excessive burn-off.

SUMMARY OF THE INVENTION

An object of the present invention is to provide electric contact material, particularly for vacuum switches which operate with a high number of switching cycles, which meets all of the previously described requirements and which, in particular, provides both good solderability and a low welding force during contact separation after operation under arcing conditions.

The present invention attains this object by providing an electric contact material consisting essentially of a porous matrix of a refractory metal, such as tungsten or molybdenum, and having its pores impregnated with an alloy consisting essentially of a telluride-forming metal and/or a telluride of such metal.

More particularly, the telluride-forming metal may be copper, silver or lead. The impregnating alloy may consist predominantly of such a metal and a relatively small but sufficient amount of the telluride, or the alloy may consist entirely of the metallic telluride.

Thus, the impregnating alloy may consist of metallic copper and copper telluride, or may be entirely copper telluride; or metallic silver and silver telluride, or silver telluride alone may be used; or metallic lead and lead telluride, or lead telluride alone may be used.

The new contact material can be soldered without difficulty, to the current carrying studs or components of a vacuum switch so as to meet the demands of mechanized switch production. For example, conventional silver solders, such as silver/copper eutectic, and soft solders comprising tin and lead alloys, may be effectively used. The new contact material provides high solder joint strength, having a strength at least equalling that of the impregnating alloy.

Surprisingly, this new readily solderable material also provides substantial freedom from contact welding or sticking following high switching stresses involving heavy arcing conditions, while meeting all of the other requirements previously referred to.

The above apparent contradiction of excellent solderability and non-sticking characteristics are believed to be due to the fact that the telluride of the copper, silver or lead, is not decomposed either when the alloy is heated during impregnation of the porous matrix of refractory metal, or by the temperature stresses occurring during the soldering, so that no elemental tellurium is present in the completed switching material or in the soldered contact assembly. However, when the contact material is in service, during switching operations under arcing conditions, the arc causes decomposition and evaporation of the telluride, so that a vapor of tellurium and of the telluride-forming metal is formed as elemental components. Electrical contacts for vacuum switches are designed to dissipate the arcing heat rapidly, and, therefore, the contacts cool so rapidly that this vapor of the decomposed telluride is condensed on the surface of the cooled contacts and this occurs so rapidly that reformation back to the telluride form is prevented. The result is a brittle deposit of tellurium on the contact surfaces in film form which causes an effective reduction of not only the contact welding or sticking forces, but also of the interrupt current.

DETAILED DESCRIPTION OF THE INVENTION

After the new electric contact material of the present invention is made, it is easily soldered by mechanized production methods to the current carrying elements of the vacuum switches, in the same manner and with the same facility as is possible in the case of the prior art electric contact materials of good solderability but which do not meet the requirements as to low welding force. It is to be assumed that the current carrying switch elements will be of the usual design providing rapid abstraction of arcing heat from the contacts after they open and the arc is extinguished.

Therefore, the most effective detailed description of the invention is provided by examples of the manufacture of the new material. This is the function of the following:

EXAMPLE 1

To prepare a contact material of the composition WCu30Tel, tungsten powder with a grain size under 100 $\mu$ is pressed at a pressure of 3 tons/cm$^2$ into the desired shape and subsequently sintered in vacuum at temperatures between 1900° and 2000° C for 1 hour so that a porous sintered matrix or skeleton is formed. This sintered matrix is subsequently impregnated with an impregnating substance of $Cu_2Te$-containing copper at 1150° C in a hydrogen atmosphere, the heating time being 20 minutes, avoiding telluride decomposition. The impregnating substance is prepared by melting in a vacuum, in a covered graphite crucible, a powder mixture of 97% by weight of copper and 3% by weight of tellurium. After the impregnating process the hydrogen is pumped off until a vacuum of about $10^{-4}$ Torr is reached, and the material is then allowed to cool down in the vacuum.

EXAMPLE 2

To produce a contact material of the composition WCu15Te15, tungsten powder with a grain size of less than 100 $\mu$ is pressed to form at a pressure of 3 tons/cm$^2$ and subsequently sintered in a vacuum at 1900° to 2000° C for 1 hour to form a sintered porous matrix. This sintered matrix is subsequently impregnated at a temperature of 1150° C in a hydrogen atmosphere for 20 minutes with an impregnating substance of $Cu_2Te$, which had been prepared by melting in a vacuum, in a covered graphite crucible, a powder mixture of 50% by weight of copper and 50% by weight of tellurium. After the impregnating process the hydrogen is pumped off until a vacuum of about $10^{-4}$ Torr is reached, and the material is then allowed to cool down in the vacuum.

EXAMPLE 3

To produce a contact material of the composition MoAg25Te1, a molybdenum powder with a grain size of less than 40 $\mu$ is pressed to form at a pressure of 1.5 tons/cm$^2$ and is subsequently sintered in a vacuum at a temperature between 1400° and 1700° C for 1 hour to form a sintered porous matrix. This sintered matrix is then impregnated with an impregnating substance of $Ag_2Te$-containing silver for 20 minutes in a hydrogen atmosphere at 1000° C. The impregnating substance is prepared by melting in a vacuum, in a covered graphite crucible, a powder mixture of 96% by weight of silver and 4% by weight of tellurium. After the impregnating process the hydrogen is pumped off until a vacuum of about $10^{-4}$ Torr is reached, and the material is then allowed to cool down in the vacuum.

EXAMPLE 4

To produce a contact material of the composition WAg15Te9, a tungsten powder with a grain size of less than 100 $\mu$ is pressed to form at a pressure of 3 tons/cm$^2$ and subsequently sintered in a vacuum at 1900° to 2000° C for 1 hour to form a sintered porous matrix. This sintered matrix is then impregnated for 20 minutes in a hydrogen atmosphere at 1000° C, with an impregnating substance of $Ag_2Te$, which had been prepared from 63% by weight Ag and 37% by weight Te in a covered graphite crucible. After the impregnating process, the hydrogen is pumped off until a vacuum of about $10^{-4}$ Torr is reached and the material is then allowed to cool in the vacuum.

EXAMPLE 5

To produce a contact material of the composition MoPb30Te1, a molybdenum powder with a grain size of less than 40 $\mu$ is pressed at a pressure of 1.5 tons/cm$^2$ and subsequently sintered in a vacuum at 1400° to 1700° C for 1 hour to form a sintered matrix. This sintered matrix is then impregnated with an impregnating substance of PbTe-containing lead for 30 minutes in a hydrogen atmosphere at a temperature of 800° C. The impregnating substance had been prepared by melting in a vacuum, in a covered graphite crucible, a powder mixture of 97.0% by weight of lead and 3% by weight of tellurium. After the impregnating process the hydrogen is pumped off until a vacuum of about $10^{-4}$ Torr is reached and the material is then allowed to cool down in the vacuum.

EXAMPLE 6

To produce a contact material of the composition WPb25Te15, a tungsten powder with a grain size of less than 100 $\mu$ is pressed at a pressure of 3 tons/cm$^2$ to form a compact which is subsequently sintered in a vacuum at 1900° to 2000° C for 1 hour to form a sintered porous matrix. This sintered matrix is subsequently impregnated for 30 minutes in a hydrogen atmosphere at 1000° C, with an impregnating substance of PbTe, which had been prepared by melting in a vacuum, in a covered graphite crucible, a powder mixture of 62% by weight of lead and 38% by weight of tellurium. After the impregnating process, the hydrogen is pumped off until a vacuum of $10^{-4}$ Torr is reached and the material is then allowed to cool down in the vacuum.

Concerning these examples, the usual prior art powder metal techniques are applicable. The refractory powder compact after the usual sintering to form the desired matrix, which may be of finished or semi-finished shape, is impregnated in the usual way by placing the matrix in a refractory container with the impregnating substance on top of the matrix and in sufficient volume to fill all of the pores of the matrix to the fullest extent possible. Then while protected by the hydrogen, or other adequately inert atmosphere, the impregnating is effected by heating to the temperatures and times specified in each instance.

What is claimed is:

1. Electric contact material consisting essentially of a porous matrix of a metal selected from the class consisting of tungsten and molybdenum and having its pores substantially impregnated with an impregnant selected from the class consisting essentially of an alloy of copper and copper telluride, copper telluride, an alloy of silver and silver telluride, silver telluride, an alloy of lead and lead telluride, and lead telluride.

2. The material of claim 1 in which said telluride is decomposed into a vapor of its elemental components by the heat of electrical arcing, and said amount of telluride is sufficient to provide said vapor in an amount which condenses on said material after termination of the arcing and forms a brittle deposit thereon providing effective contact welding protection.

* * * * *